US011067927B2

(12) United States Patent
Yonekubo

(10) Patent No.: US 11,067,927 B2
(45) Date of Patent: Jul. 20, 2021

(54) HEATER, IMAGE HEATING DEVICE, AND IMAGE FORMING APPARATUS HAVING PLURAL HEATING RESISTORS AND HAVING PLURAL ELECTRIC CONTACT PORTIONS CONNECTED TO DIFFERENT POLES OF A POWER SUPPLY

(71) Applicant: CANON KABUSHIKI KAISHA, Tokyo (JP)

(72) Inventor: Hideaki Yonekubo, Yokohama (JP)

(73) Assignee: Canon Kabushiki Kalsha, Tokyo (JP)

( * ) Notice: Subject to any disclaimer, the term of this patent is extended or adjusted under 35 U.S.C. 154(b) by 0 days.

(21) Appl. No.: 16/882,967

(22) Filed: May 26, 2020

(65) Prior Publication Data

US 2020/0379385 A1 Dec. 3, 2020

(30) Foreign Application Priority Data

May 27, 2019 (JP) ..... JP2019-098536

(51) Int. Cl.
*G03G 15/20* (2006.01)
*G03G 15/00* (2006.01)

(52) U.S. Cl.
CPC ..... *G03G 15/2053* (2013.01); *G03G 15/80* (2013.01)

(58) Field of Classification Search
USPC ..... 399/328
See application file for complete search history.

(56) References Cited

U.S. PATENT DOCUMENTS 7,312,420 B2 * 12/2007 Smith ..... H05B 1/0213 219/216
9,494,899 B2 11/2016 Nakahara et al.
2005/0280682 A1 * 12/2005 Kato ..... G03G 15/2042 347/102
2013/0026154 A1 * 1/2013 Taniguchi ..... G03G 15/2053 219/385
2015/0293483 A1 * 10/2015 Nakahara ..... H05B 3/06 399/333
2017/0364001 A1 * 12/2017 Takagi ..... G03G 15/2053

FOREIGN PATENT DOCUMENTS

JP 2006012444 A 1/2006
JP 2008166096 A 7/2008
JP 2014106279 A 6/2014
JP 2014139660 A 7/2014
JP 2015060710 A 3/2015

* cited by examiner

*Primary Examiner* — Q Grainger
(74) *Attorney, Agent, or Firm* — Venable LLP

(57) ABSTRACT

A heater of an image heating device, the heater including: a substrate; a first heating resistor and a second heating resistor on the substrate; first to third electric contact portions for electric connection to a power supply; a first conductive portion that connects the first electric contact portion with the first heating resistor; a second conductive portion that connects the second electric contact portion the second heating resistor; and a third conductive portion that connects the third electric contact portion and the first heating resistor and also connects the third contact portion with the second heating resistor, wherein the first electric contact portion is provided close to one longitudinal end of the substrate, the second electric contact portion is provided close to the other longitudinal end of the substrate, and the third electric contact portion is provided close to the center of the substrate in the longitudinal direction.

11 Claims, 14 Drawing Sheets

PARALLEL CONNECTION STATE

SERIES CONNECTION STATE

HEATER, IMAGE HEATING DEVICE, AND IMAGE FORMING APPARATUS HAVING PLURAL HEATING RESISTORS AND HAVING PLURAL ELECTRIC CONTACT PORTIONS CONNECTED TO DIFFERENT POLES OF A POWER SUPPLY

BACKGROUND OF THE INVENTION

Field of the Invention

The present invention relates to an image heating device such as a fixing device, a glossing device that improves the glossiness of a toner image by reheating the toner image fixed on a recording material, and the like, which are mounted on an image forming apparatus such as an electrophotographic copying machine or a printer, and to a heater used in such a device.

Description of the Related Art

In recent years, from the viewpoint of quick start and energy saving, a fixing device of a film heating type has been put into practical use as a fixing device for heating and fixing an image formed on a recording material, which is an example of the above-described image heating device. The fixing device of a film heating system includes a heater as a heating body, a heater support (stay), a fixing film conveyed while being pressed against the heater, and a pressure roller that brings a recording material as a material to be heated through the fixing film into close contact with the heater. In this system, the heat of the heater is applied to the recording material through the fixing film to heat and fix an unfixed image formed and borne on the recording material surface to the recording material surface.

FIG. 9 shows an example of a heater used in such heating device of a film heating type. FIG. 9 is a plan view of the heater. The heating resistor 115 is disposed reciprocally with respect to the substrate 114 with the same resistance value. The forward path and the return path of the heating resistor 115 are connected by a conductive portion 121. Reference numeral 123 denotes a portion to which the power supply connector of the electrode is connected. A direction perpendicular to the conveyance direction of a recording material such as paper is defined as a longitudinal direction, and such a type of heater is hereinafter referred to as a longitudinal energizing type.

In an image forming apparatus using a heater as shown in FIG. 9, which is a fixing device of a film heating type, where small-size paper is continuously printed, a region of the heater through which the recording material does not pass (non-paper-passing region) is known to be excessively heated (so-called non-paper-passing portion temperature rise). Where the temperature of the non-paper-passing region of the heater rises excessively, the holder holding the heater and the pressure roller may be damaged by heat.

Therefore, the heater of the fixing device has been improved. Japanese Patent Application Publication No. 2006-012444 proposes a heater in which excessive temperature rise in a non-paper-passing region can be suppressed. FIG. 10 shows an example of such a heater. Reference numeral 27 denotes a heater substrate, and reference numerals 37*a* to 37*d* denote conductive portions. Power feeding connectors are connected to the power supply portions 21 and 22. Assuming that the direction perpendicular to the conveyance direction of the recording material is the longitudinal direction, the four conductive portions 37*a* to 37*d* are provided along the longitudinal direction of the substrate 27. Reference numerals 15*a* and 15*b* denote heating resistors connected between conductive portions and having a positive temperature coefficient (PTC, positive temperature coefficient of resistance) characteristic. Where electric power is supplied from the power supply portions 21 and 22, the heating resistors 15*a* and 15*b* generate heat (hereinafter, such a type of heater is referred to as a conveyance direction energizing type).

In the heater, when a small-size recording material is passed through a region (large-size paper passing region) through which a large-size recording material used in a printer passes, a non-paper-passing region is generated outside the region through which the small-size recording material passes (small-size paper passing region). In the small-size paper passing region, the heat is taken away by the recording material, so that the amount of heat relatively decreases. However, in the non-paper-passing region, the temperature rises because the recording material does not take the heat. However, as the heat is generated, the resistance of the heating resistor increases, but the heating resistor is connected in parallel to the power supply portions 21 and 22. For this reason, the resistance value of the heating resistor becomes small, and the current easily flows, which has an effect of suppressing heat generation. Therefore, the temperature rise in the non-paper-passing region can be suppressed.

SUMMARY OF THE INVENTION

The following problem is encountered in the conventional heater of the conveyance direction energizing type in the above-described image forming apparatus of a film heating type.

In the heater of the conveyance direction energizing type which is disclosed in Japanese Patent Application Publication No. 2006-012444 and shown in FIG. 10, heat generation unevenness occurs in the longitudinal direction of the heater even though paper is not passed. The reason will be described below with reference to FIGS. 11A and 11B. FIG. 11A is a diagram illustrating a heat generation distribution in the longitudinal direction of the heating resistor 15*a* and FIG. 11B is a diagram illustrating a potential distribution in the longitudinal direction of the conductive portions 37*a* and 37*b* when power is supplied to the heating resistor 15*a*. Here, heat generation amount at each longitudinal position of the heating resistor 15*a* is determined by a potential difference at each longitudinal position of the conductive portion 37*a* and the conductive portion 37*b*.

First, the potential distribution of the conductive portions 37*a* and 37*b* will be described with reference to FIG. 11B. The conductive portions 37*a* to 37*d* have high conductivity but the resistance value thereof is not zero. Therefore, as shown in the image of the potential distribution in FIG. 11B, a voltage drop occurs in the conductive portion 37*a* and the conductive portion 37*b*, and the potential difference between the conductive portion 37*a* and the conductive portion 37*b* has a distribution such as shown by a dotted line in FIG. 11B. Further, a voltage drop also occurs in the conductive portions 37*c* and 37*d*. FIG. 11B illustrates a state in which the heating resistor 15*a* is supplied with power through a power supply portion 22 so that the potential difference at each longitudinal position of the conductive portion 37*a* becomes a negative value. Meanwhile, a state is shown in which the heating resistor 15*a* is supplied with power through a power supply portion 21 so that the potential difference at each longitudinal position of the conductive portion 37*b* becomes a positive value.

The voltage values shown in FIG. 11B indicate values at a certain moment. When the AC voltage is applied, there is also a timing at which the potential difference at each longitudinal position of the conductive portion 37*a* becomes a positive value, and the potential difference at each longitudinal position of the conductive portion 37*b* becomes a negative value.

The heat generation amount at each longitudinal position of the heating resistor 15*a* is determined by a potential difference between each longitudinal position of the conductive portion 37*a* and the conductive portion 37*b*. The potential difference between the conductive portion 37*a* and the conductive portion 37*b* has a distribution such as indicated by a dotted line in FIG. 11B. Accordingly, as shown in FIG. 11A, the heater of the conveyance direction energizing type shown in FIG. 10 has a heat generation distribution in which the central portion in the longitudinal direction of the heater has the minimum value and the both end portions have the maximum value. The heat generation distribution of the heating resistor 15*b* is the same as that of the heating resistor 15*a*. As described above, in the heater of the conveyance direction energizing type, heat generation unevenness occurs in the longitudinal direction.

Furthermore, when a failure or the like of the circuit for controlling the heater temperature occurs, the heater may be cracked. Therefore, in the heater of the longitudinal direction energization type as shown in FIG. 9, the position of the heating resistor is arranged at the end of the substrate with respect to the lateral direction which is the recording material conveyance direction, so that the heater is less likely to crack. This is because, when the heating resistor is disposed at the end of the substrate with respect to the recording material conveyance direction, the temperature difference in the recording material conveyance direction is reduced, and the thermal stress generated on the heater substrate can be reduced.

Also, in the study of the inventors, a heater cracking test was performed on the heater of the conveyance direction energizing type when a certain amount or more of power was applied. In FIG. 12, d represents the width of the heater substrate, and t represents the position of the heating resistor from the end of the heater substrate. t/d is an index of how close the heating resistor is located to the end of the heater substrate. The smaller is the value of t/d, the closer the position of the heating resistor is to the end of the heater substrate. FIG. 12 shows the tendency of the heater cracking time when the inventors performed a heater cracking test while varying t/d in the heater of FIG. 12. In the heater of the conveyance direction energizing type, similarly to the heater of the longitudinal direction energizing type, as the position of the heating resistor is closer to the end of the heater substrate (as t/d is smaller), cracking of the heater is less likely to occur.

As described above, a heater disclosed in Japanese Patent Application Publication No. 2014-106279 as shown in FIG. 13 has been proposed to improve both the heat generation unevenness in the longitudinal direction of the substrate and the heater cracking, which is the problem of the heaters of the conveyance direction energizing type. First, since the conductive portions 131*a* and 131*b* at both lateral ends of the heater are thin, the positions of the heating resistors 135*a* and 135*b* can be made close to the lateral ends of the heater. This is more advantageous in terms of heater cracking prevention than in the heater of the conveyance direction energizing type such as disclosed in Japanese Patent Application Publication No. 2006-012444.

Further, as described below, the heat generation unevenness in the longitudinal direction of the substrate is also more advantageous than in the heater of the conveyance direction energizing type disclosed in Japanese Patent Application Publication No. 2006-012444. FIG. 14A is a diagram illustrating the heat generation distribution in the longitudinal direction of the heater in FIG. 13 and FIG. 14B is a diagram illustrating the potential distribution in the longitudinal direction of the conductive portions 131*a* and 131*c*.

As shown in the image of the potential distribution in FIG. 14B, a voltage drop occurs on the conductive portion 131*a* and the conductive portion 131*c*, and the potential difference between the conductive portion 131*a* and the conductive portion 131*c* is distributed as indicated by a dotted line in FIG. 14B. Further, a voltage drop occurs on the conductive portion 131*b* in the same manner as on the conductive portion 131*a*. FIG. 14B shows a state in which a negative voltage value is supplied by the power supply portions 132*a* and 132*d* connected to the conductive portions 131*a* and 131*b*, and a positive voltage value is supplied by the power supply portions 132*c* and 132*d* connected to the conductive portion 131*c*.

The voltage values shown in FIG. 14B indicate values at a certain moment. When an AC voltage is applied, there is a timing at which the conductive portion 131*c* has a negative voltage value and the conductive portions 131*a* and 131*b* have a positive voltage value.

However, in the heater disclosed in Japanese Patent Application Publication No. 2014-106279, there are cases where the performance against heat generation unevenness and heater cracking in the longitudinal direction is insufficient. For example, when trying to narrow the width of the heater in the lateral direction, it is necessary to maintain t/d in order to maintain the performance against the heater cracking. By doing so, the conductive portions at both lateral ends of the heater should be thinned, and in some cases, an image defect occurs due to heat generation unevenness in the longitudinal direction.

In view of the above, it is an object of the present invention to provide a heater of the conveyance direction energizing type, in which heat generation unevenness in the longitudinal direction can be suppressed, and at the same time, a sufficient tolerance against heater cracking can be ensured, and also to provide an image heating device and an image forming apparatus using the heater.

In order to achieve the above object, a heater used in an image heating device for heating an image formed on a recording material according to the present invention includes the following:

a substrate;

a first heating resistor that is provided on the substrate along a longitudinal direction of the substrate and generates heat with electric power supplied from a power supply;

a second heating resistor that is provided on the substrate along the longitudinal direction of the substrate in parallel with the first heating resistor and generates heat with electric power supplied from the power supply;

a first electric contact portion for electric connection to the power supply;

a first conductive portion that electrically connects the first electric contact portion with one lateral end of the first heating resistor on the side opposite that facing the second heating resistor, the first conductive portion being electrically connected to the first heating resistor on the one lateral end of the first heating resistor throughout the longitudinal direction, the lateral direction being a direction perpendicular to the longitudinal direction;

a second electric contact portion for electric connection to the power supply;

a second conductive portion that electrically connects the second electric contact portion with the other lateral end of the second heating resistor, the second conductive portion being electrically connected to the second heating resistor on the other lateral end of the second heating resistor throughout the longitudinal direction;

a third electric contact portion for electric connection to the power supply; and a third conductive portion that electrically connects the third electric contact portion and the other lateral end of the first heating resistor and also electrically connects the third contact portion with the one lateral end of the second heating resistor, the third conductive portion being electrically connected to the first heating resistor on the other lateral end of the first heating resistor throughout the longitudinal direction and being electrically connected to the second heating resistor on the one lateral end of the second heating resistor throughout the longitudinal direction, wherein, in the heater, the first electric contact portion is provided close to one longitudinal end of the substrate, the second electric contact portion is provided close to the other longitudinal end of the substrate, and the third electric contact portion is provided close to the center of the substrate in the longitudinal direction.

In order to achieve the above object, the image heating device according to the present invention includes the following:

a heating unit including above mentioned heater; and a switching portion for switching between a state where the first electric contact portion and the second electric contact portion are electrically connected to one pole of the power supply, and the third electric contact portion is electrically connected to the other pole of the power supply, and a state where the first electric contact portion is electrically connected to one pole of the power supply, the second electric contact portion is electrically connected to the other pole of the power supply, and the third electric contact portion is not electrically connected to either pole of the power supply.

Further, in order to achieve the above object, an image forming apparatus according to the present invention includes the following:

an image forming portion that forms a toner image on a recording material; and a fixing portion that fixes the toner image formed by the image forming portion to the recording material, wherein the fixing portion is above mentioned image heating device.

As described hereinabove, according to the present invention, in a heater of the conveyance direction energizing type, heat generation unevenness in a longitudinal direction can be suppressed, and at the same time, a sufficient tolerance against heater cracking can be ensured.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

EXAMPLE 1

(1) Image Forming Apparatus

Figure 1:
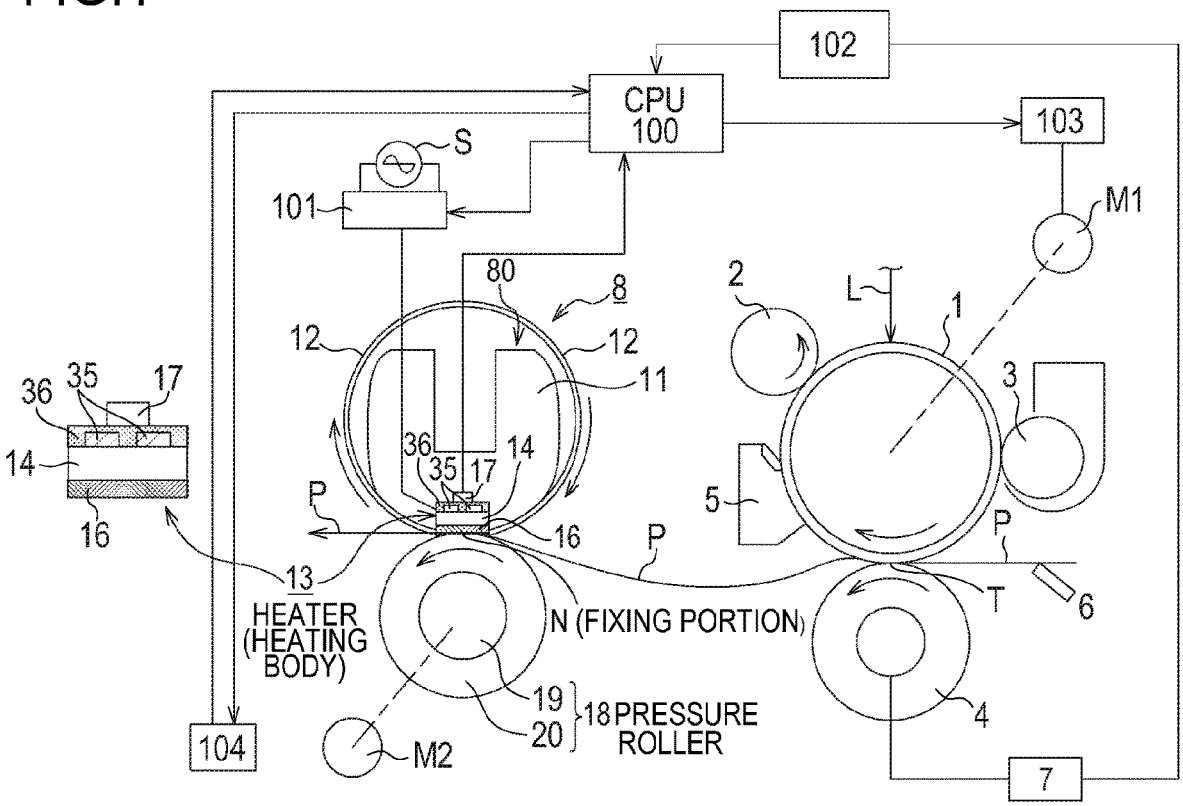
FIG. 1 is a schematic configuration diagram of an image forming apparatus of the present invention.

Hereinafter, Example 1 of the present invention will be described with reference to the drawings. In the following description, a direction perpendicular to the conveyance direction of the recording material is defined as a longitudinal direction, and a direction perpendicular to the longitudinal direction, that is, the conveyance direction of the recording material, is defined as a lateral direction. FIG. 1 is a schematic configuration diagram of an image forming apparatus equipped with a fixing device as an example of an image heating device in the present invention. Reference numeral 1 denotes a drum-type electrophotographic photosensitive member that rotates in the direction of an arrow (hereinafter, referred to as a photosensitive drum). M1 is a main motor for driving the photosensitive drum 1 and the like. A controller 103 for the motor M1 is controlled by a CPU 100. The photosensitive drum 1 is uniformly charged to a predetermined polarity and potential by a charging roller 2. The charged surface of the photosensitive drum 1 is scanned by a laser beam L modulated according to an image signal, and an electrostatic latent image corresponding to the image signal is formed on the photosensitive drum. This electrostatic latent image is developed by a toner supplied from a developing device 3. The toner image formed on the photosensitive drum is transferred onto a recording material P at a transfer position T by a transfer roller 4. A power supply 7 applies a transfer bias to the transfer roller 4. Thereafter, the recording material P carrying the toner image is conveyed to a fixing device 8 as a fixing portion (image heating portion), and the toner image is heated and fixed on the recording material P. The recording material P on which the fixing process has been performed is outputted outside the image forming apparatus. The configuration excluding the fixing device 8 in the series of image forming processes corresponds to an image forming portion in the present example. Reference numeral 5 denotes a cleaner for cleaning the photosensitive drum, and reference numeral 6 denotes a sensor for detecting the passage timing of the recording material.

(2) Fixing Device

The fixing device 8 is of a pressure roller driving type in which a pressure roller 18 is driven by the motor M2, and the fixing film 12 rotates following the rotation of the pressure roller. In the fixing device 8, a fixing nip portion N is formed by a ceramic heater 13 and the pressure roller 18. The recording material P carrying the toner image is conveyed at the fixing nip portion N while the toner image contacts the fixing film 12. Reference numeral 11 denotes a holder for holding the heater 13. The heater 13 has a substrate 14, a heating resistor 35 printed on the substrate 14, a glass coat layer 36 covering the heating resistor 35, and a coat layer 16 sliding on the fixing film 12. Reference numeral 19 denotes a core of the pressure roller, 20 denotes an elastic layer provided on the core 19, and 17 denotes a temperature detecting element for detecting the temperature of the heater 13. A thermal switch as a safety element is provided on the back surface of the heater 13 (not shown). This thermal switch is disconnected and stops the power supply to the heater 13 when the back surface of the heater abnormally generates heat. A heating unit 80 being in contact with an inner surface of the cylindrical fixing film 12 includes the heater 13 and the holder 11.

The heating resistor 35 of the heater 13 is connected to the AC power supply S through the triac 101. The heating resistor 35 generates heat when an AC voltage is applied (power is supplied) from the AC power supply S, and heats the toner image formed on the recording material by using the heat thereof. In addition, the heat generation causes rapid rise in temperature of the entire heater 13 having a low heat capacity. The temperature of the heater 13 is detected by a thermistor 17. The CPU 100 controls the triac 101 so that the detection temperature of the thermistor 17 is maintained at the set temperature. The control method is preferably phase control or wave number control.

In order to keep the heater 13 at a desired temperature irrespective of the size of the recording material P during the fixing process, the thermistor 17 is disposed close to a conveyance reference for the recording material P in the longitudinal direction of the heater 13 (a direction perpendicular to the paper surface in FIG. 1). In the image forming apparatus of the present example, the conveyance reference (center reference) is set such that the center of the recording material in the width direction (=longitudinal direction of the heater) coincides with the center of the recording material conveyance path in the image forming apparatus in the width direction (=longitudinal direction of the heater). The CPU 100 controls the energization of the heater 13 so that the temperature of the heater 13 rises when the detection temperature of the thermistor 17 is lower than a predetermined set temperature, and the temperature of the heater 13 falls when the detection temperature is higher than the predetermined set temperature.

(3) Configuration of Heater

Figure 2:
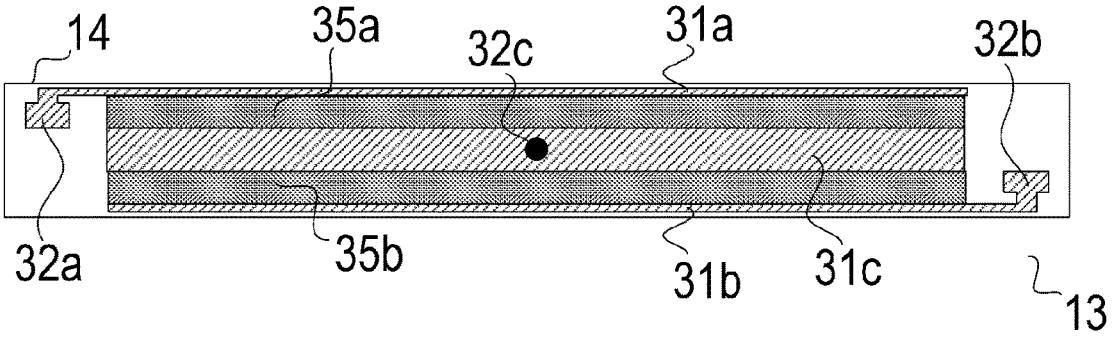
FIG. 2 is a plan view of a heater 13 mounted on a fixing device of Example 1.

FIG. 2 is a plan view of the heater 13 mounted on the fixing device of the present example. Reference numeral 14 denotes an alumina substrate having a thickness of 1 mm, a length of 290 mm, and a width of 7 mm (in the recording material conveyance direction). Reference numerals 32*a* to 32*c* denote first to third power supply contact portions (electric contact portions), which are arranged at both ends and the center in the longitudinal direction, respectively. The contact portions are made of a material in which glass powder is mixed with an electrically conductive material (conductor), and a desired volume resistance value can be adjusted by changing the compounding ratio of the electrically conductive material and glass powder.

First to third power supply connectors provided in the fixing device are attached to the first to third power supply contact portions 32*a* to 32*c*, respectively. The first power supply connector and the second power supply connector are of the same electric polarity, and the third power supply connector is of the opposite polarity. That is, the first power supply contact portion 32*a* (first electric contact portion) is electrically connected to one pole of the power supply through the first power supply connector, and the second power supply contact portion 32*b* (second electric contact portion) is electrically connected to one pole of a power supply having the same polarity through the second power supply connector. Meanwhile, the third power supply contact portion 32*c* (third electric contact portion) is electrically connected to the other pole of the power supply having the opposite polarity through the third power supply connector.

First to third conductive portions 31*a* to 31*c* are provided on the substrate 14 along the longitudinal direction of the substrate 14 on the substrate. The first to third power supply contact portions 32*a* to 32*c* are connected to the first to third conductive portions 31*a* to 31*c*, respectively. Specifically, the first power supply contact portion 32*a* close to one longitudinal end of the substrate is connected to apply a voltage (supply power) to a below-described first heating resistor 35*a* through the first conductive portion 31*a*. The second power supply contact portion 32*b* close to the other longitudinal end of the substrate is connected to apply a voltage (supply power) to a below-described second heating resistor 35*b* through the second conductive portion 31*b*. The third power supply contact portion 32*c* is provided in the third conductive portion 31*c* close to the center of the substrate in the longitudinal direction.

The first heating resistor 35*a* and the second heating resistor 35*b* are provided in parallel with each other on the substrate 14 along the longitudinal direction on the substrate. The first conductive portion 31*a* is formed to extend in the longitudinal direction on the substrate so as to electrically connect the first power supply contact portion 32*a* with one lateral end of the first heating resistor 35*a*, the lateral direction being a direction perpendicular to the aforementioned longitudinal direction of the substrate. The first conductive portion is provided so as to be connected to the first heating resistor 35*a* throughout the longitudinal direction on one lateral end of the first heating resistor 35*a* on the side opposite that facing the second heating resistor 35*b*. The second conductive portion 31*b* is formed to extend in the longitudinal direction of the substrate, in the same manner as the first conductive portion 31*a*, so as to electrically connect the second power supply contact portion 32*b* with the other lateral end of the second heating resistor 35*b*. The second conductive portion is provided so as to be connected to the second heating resistor 35*b* throughout the longitudinal direction on the other lateral end of the second heating resistor 35*b*. Further, the third conductive portion 31*c* is provided in a shape extending in the longitudinal direction on the substrate so as to be sandwiched between the first heating resistor 35*a* and the second heating resistor 35*b*, and electrically connects the other lateral end of the first heating resistor 35*a* and the one lateral end of the second heating resistor 35*b*. The first heating resistor 35*a* and the second heating resistor 35*b* both have a PTC characteristic, and have a TCR of 500 ppm/° C.

The width of the first conductive portion 31*a* and the second conductive portion 31*b* is 0.2 mm, the width of the third conductive portion 31*c* is 2.8 mm, and the first heating resistor 35*a* and the second heating resistor 35*b* are set to 1.3 mm.

The power supply contact portions 32*a* to 32*c*, the conductive portions 31*a* to 31*c*, and the heating resistors 35*a* and 35*b* are all formed on the substrate 14 by screen printing in which thickness can be easily adjusted. Also, the paste of the same material is used for the two heating resistors 35, and the length of the heating resistors 35 is about 220 mm. As a material of the heating resistor 35, for example, ruthenium oxide is used in the present example, but this material is not limiting. That is, a material in which glass powder or the like is mixed with an electric resistance material such as Ag/Pd is used, and the volume resistance value of the resistor may be changed by changing the compounding ratio of each material.

First, pastes of the first to third power supply contact portions 32*a* to 32*c* and the first to third conductive portions 31*a* to 31*c* are simultaneously screen-printed on the substrate 14, and thereafter, the first heating resistor 35*a* and the second heating resistor 35*b* are screen-printed to overlap on the conductive portions. Thereafter, a glass layer is screen-printed so as to cover the heating resistors.

Where the resistance of the conductive portions is zero or negligibly small with respect to the resistance of the heating resistors, each conductive portion is electrically connected to the heating resistor throughout the longitudinal direction thereof, and since the potential is the same as the power supply potential, the heating resistors generate heat substantially uniformly in the longitudinal direction. However, since the resistance of the conductive portion is not zero, a voltage drop occurs in the longitudinal direction of the conductive portion as the distance from the power-supplied portion increases, and heat generation unevenness occurs in the longitudinal direction of the heating resistor. This heat generation unevenness differs depending on the pattern on the substrate 14.

Figure 3A:
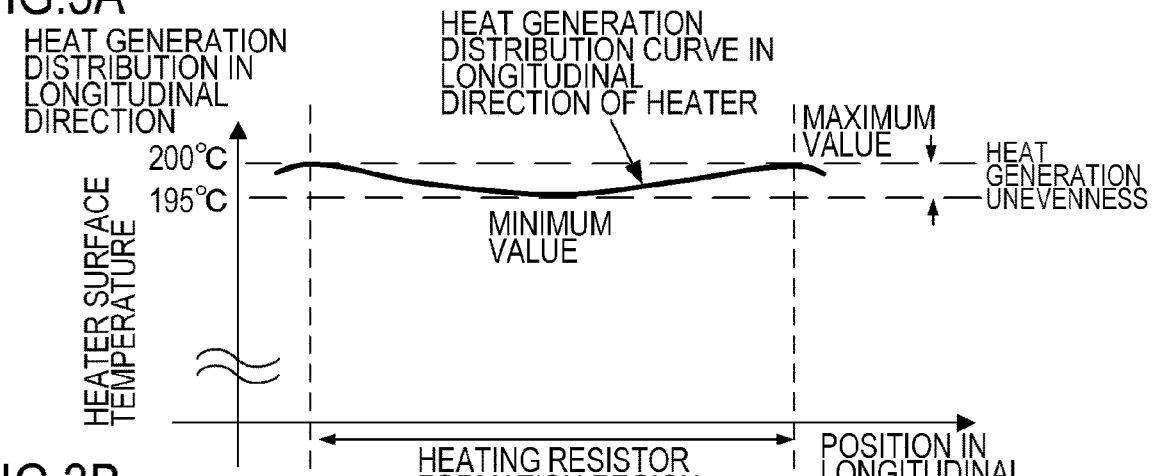
FIGS. 3A and 3B are respectively a heat generation distribution diagram and a potential distribution diagram in the longitudinal direction of the heater of Example 1.
Figure 3B:
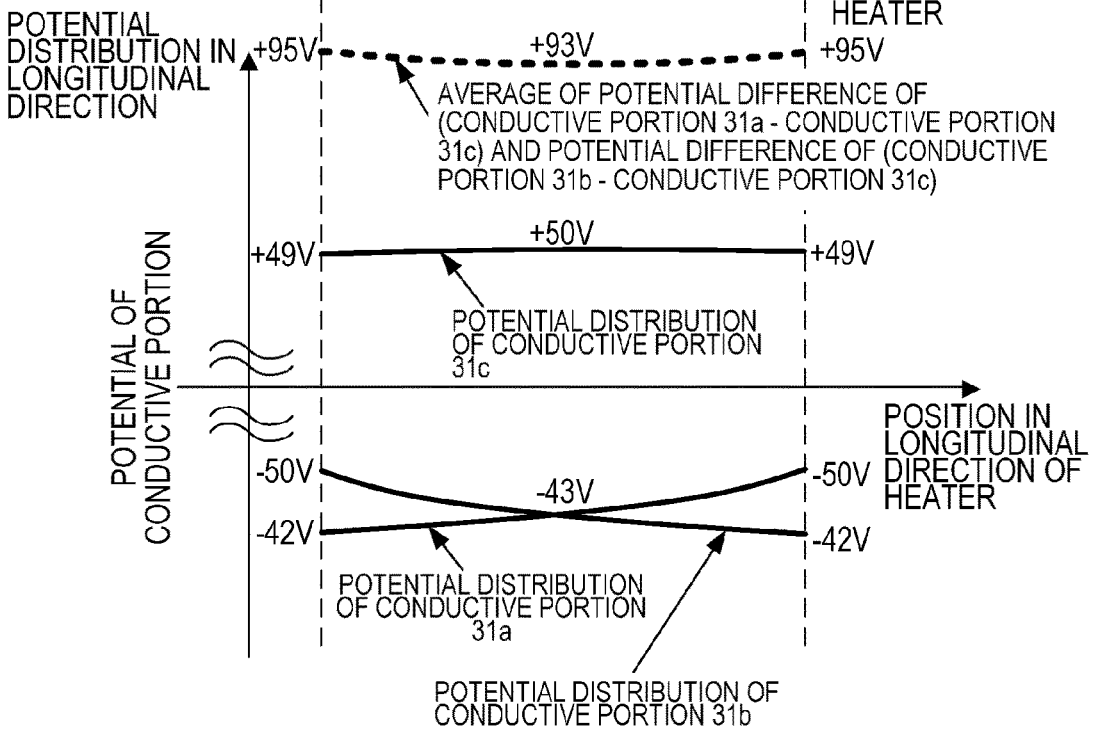

FIG. 3A is a view for explaining the heat generation distribution in the longitudinal direction of the heater in the present example and FIG. 3B is a view for explaining the potential distribution in the longitudinal direction of the first to third conductive portions 31*a* to 31*c*. FIG. 3A shows a heat generation distribution diagram in the heater longitudinal direction of the heater of the present example. In the present example, as shown in FIG. 3A, the heat generation distribution is such that the maximum value is at both ends and the minimum value is at the center in the longitudinal direction of the heater. The reason will be described below. As shown in FIG. 3B, a voltage is applied to the first heating resistor 35*a* from the first power supply contact portion 32*a*, which is located close to one longitudinal end, through the first conductive portion 31*a*. A voltage is applied to the second heating resistor 35*b* from the second power supply contact portion 32*b*, which is connected to one pole of the power supply to which the first power supply contact portion 32*a* is connected, close to the other longitudinal end through the second conductive portion 31*b*. Therefore, a voltage drop occurs from each longitudinal end of the heater toward the opposite end. Meanwhile, the third power supply contact portion 32*c* is located close to the center in the longitudinal direction and connected to the other pole of the power supply which has an electrically opposite polarity to that of the one pole of the power supply to which the first power supply contact portion 32*a* and the second power supply contact portion 32*b* are connected. A voltage is applied from the third power supply contact portion 32*c* to the first heating resistor 35*a* and the second heating resistor 35*b* through the third conductive portion 31*c*. Therefore, a voltage drop occurs from the center in the longitudinal direction of the heater toward both ends. The potential distributions due to the voltage drop generated in each conductive portion are compared, and the average of the longitudinal profile of the potential difference between the first conductive portion 31*a* and the third conductive portion 31*c* and the potential difference between the second conductive portion 31*b* and the third conductive portion 31*c* is acquired. Where the acquired average is taken as the potential distribution in the longitudinal direction of the first to third conductive portions 31*a* to 31*c*, a potential distribution is obtained such as shown in FIG. 3B in which the potential difference in the center is smaller than the potential difference at both ends in the longitudinal direction. This is because the amount of heat generated at each longitudinal position of the heating resistors 35*a* and 35*b* is determined by the potential difference at each longitudinal position of the first to third conductive portions 31*a* to 31*c*.

The voltage values shown in FIG. 3B indicate values at a certain moment. In this example, since the AC voltage is applied, there is also a timing at which the potential difference at each longitudinal position of the third conductive portion 31*c* is a negative value, and the potential difference at each longitudinal position of the first conductive portion 31*a* and the second conductive portion 31*b* is a positive value.

(4) Effect of the Present Example

As shown in Table 1 below, the heater of the present Example was compared with the heaters of Comparative Examples 1 and 2.

TABLE 1

Figure 10:
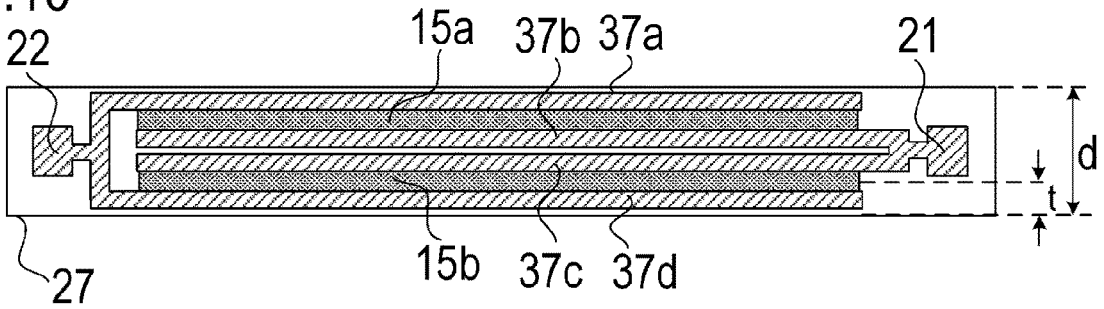
FIG. 10 is a plan view of the heater according to Japanese Patent Application Publication No. 2006-012444.
Figure 11A:
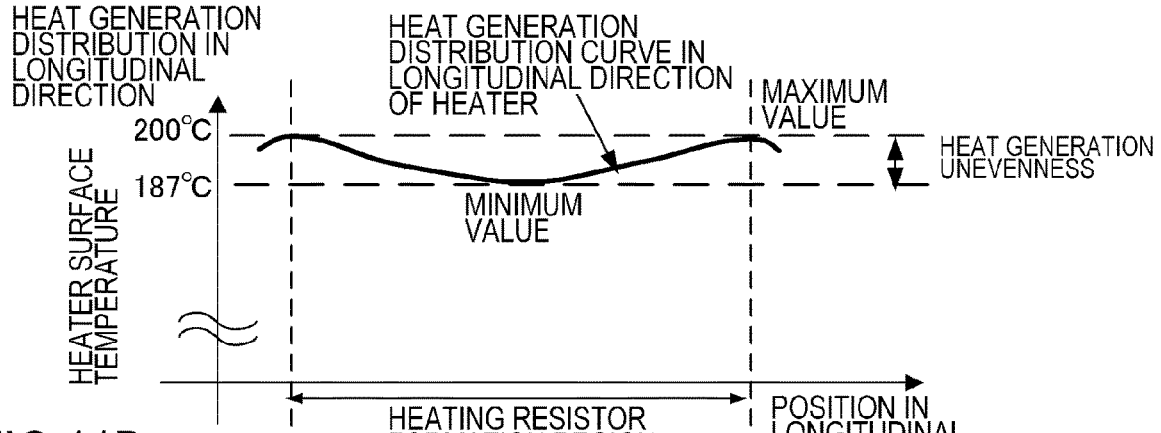
FIGS. 11A and 11B are respectively a heat generation distribution diagram and a potential distribution diagram in the longitudinal direction of the heater according to Japanese Patent Application Publication No. 2006-012444.
Figure 11B:
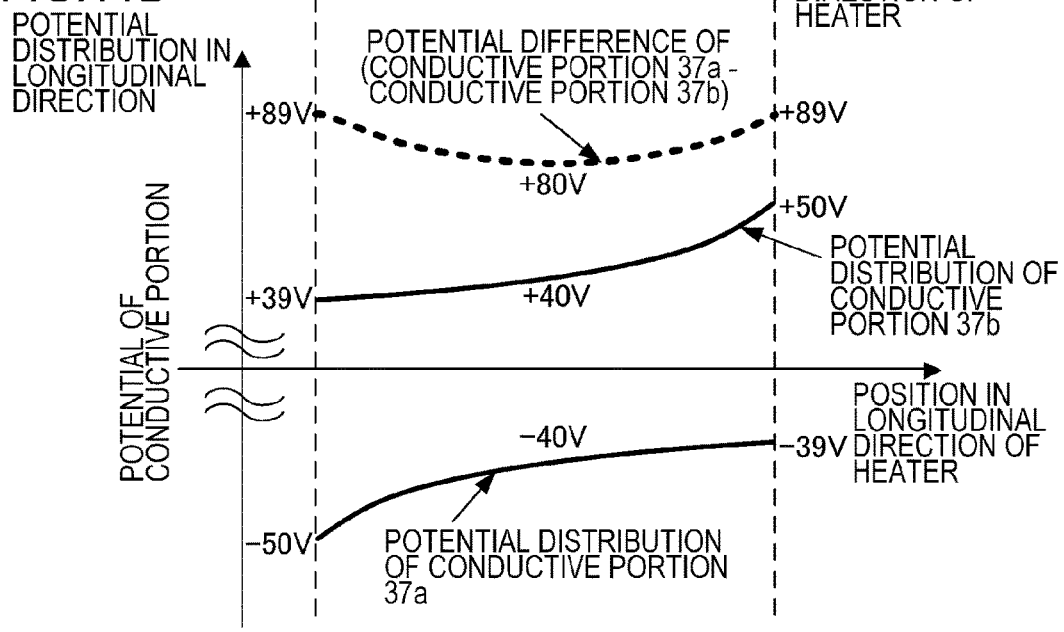
Figure 12:
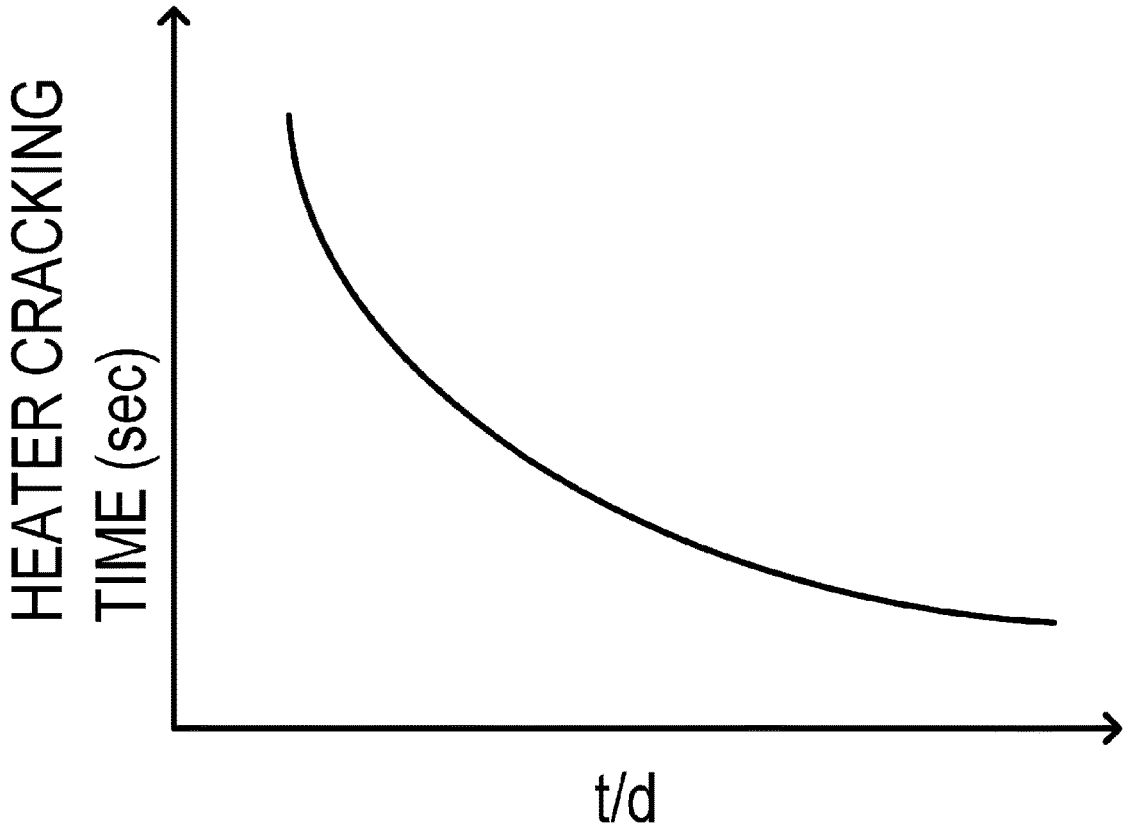
FIG. 12 is a diagram of the position of the heating resistor and the heater cracking time of the heater according to Japanese Patent Application Publication No. 2006-012444.

| | Heater pattern | t/d | Heat generation unevenness | Heater cracking time margin | Overall evaluation |
|---|---|---|---|---|---|
| Comparative Example 1 | FIG. 10 | 0.25 | 13° C. (FIG. 11A) | 1.8 sec | NG |
| Comparative Example 2 | FIG. 13 | 0.19 | 9° C. (FIG. 14A) | 4.5 sec | NG |
| Example | FIG. 2 | 0.19 | 5° C. (FIG. 3A) | 4.5 sec | OK |

In Comparative Examples 1 and 2, the substrate 14 was a heater substrate made of alumina and having a thickness of 1 mm, a length of 290 mm, and a width (recording material conveyance direction) of 7 mm. The width (recording material conveyance direction) of the heating resistor was 1.3 mm.

Figure 13:
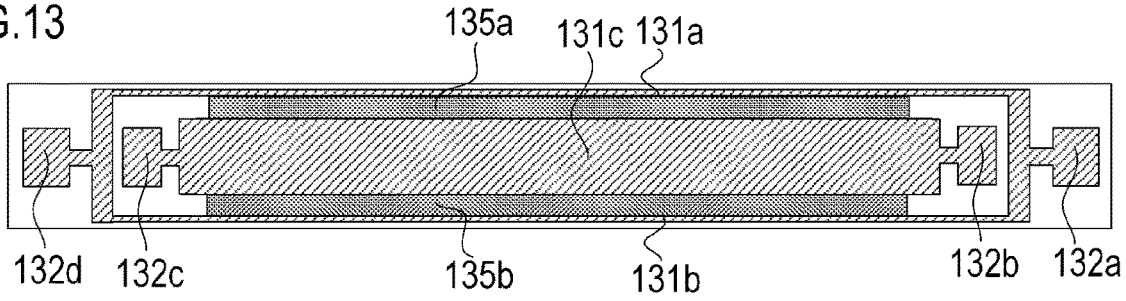
FIG. 13 is a plan view of a heater according to Japanese Patent Application Publication No. 2014-106279.
Figure 14A:
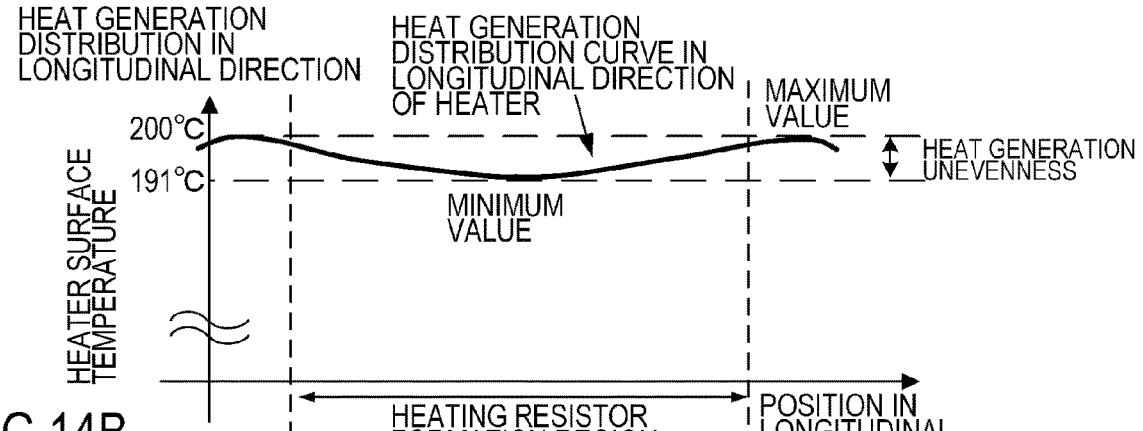
FIGS. 14A and 14B are respectively a heat generation distribution diagram and a potential distribution diagram in the longitudinal direction of the heater according to Japanese Patent Application Publication No. 2014-106279.
Figure 14B:
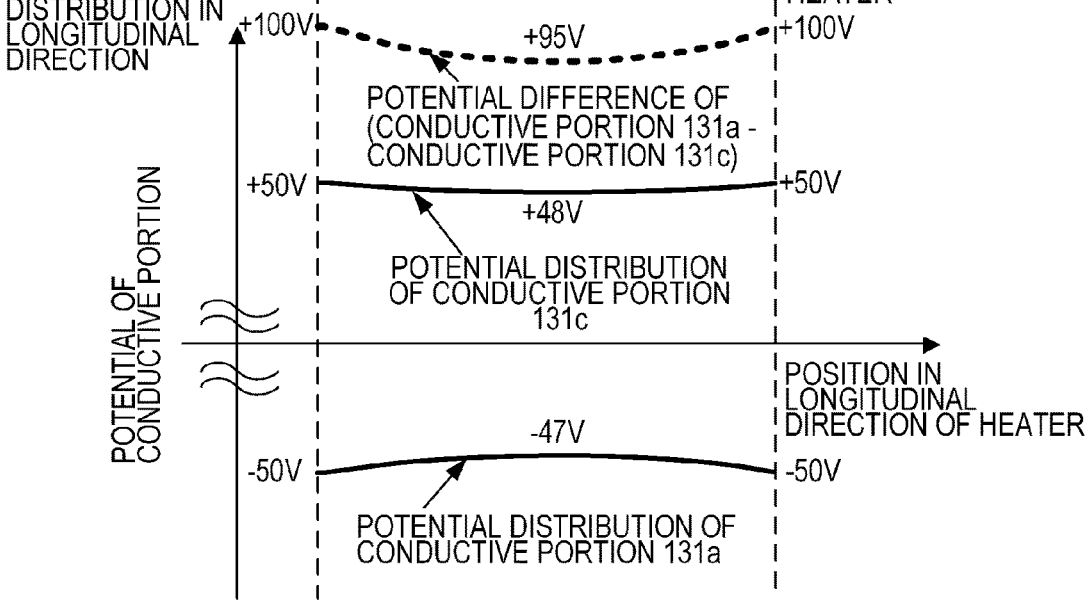

Further, the widths of all the conductive portions (recording material conveyance direction) of Comparative Example 1 shown in FIG. 10 was 0.5 mm, and the widths of the conductive portions 131*a* and 131*b* of Comparative Example 2 shown in FIG. 13 was 0.2 mm, and the width of the conductive portion 131*c* was 2.8 mm. In all of Comparative Example 1, Comparative Example 2, and the present example, the heat generation unevenness was compared by taking the total resistance value of the heater as 20Ω.

The heat generation unevenness was evaluated when supplying a power of 800 W to the heater by the difference between the maximum temperature of the heater surface temperature and the minimum temperature of the heater surface temperature in the region where the heating resistor is formed at an instant the maximum temperature reaches 200° C., as shown in, for example, FIG. 3A. In the present example, when the temperature difference is 9° C. or more, fixing unevenness can be visually recognized and image quality is problematic.

Table 1 also shows the results of measuring the time from when a constant power of 1,500 W is supplied to the heater to when the heater substrate is cracked. At the same time, the difference between the time when the heater substrate is cracked and the time when the thermal switch is turned off is shown in Table 1 as a heater cracking time margin. In the present example, this margin is required to be 2 sec or more to ensure safety.

As described above, the results of overall evaluation of heater performance conducted with respect to heat generation unevenness and heater cracking time margin are presented in Table 1 as an overall evaluation.

In Comparative Example 1, the width of one conductive portion is set to 0.5 mm, which is wider than in Comparative Example 2 and the present example. This is because by suppressing the voltage drop by lowering the resistance of the conductive portion, heat generation unevenness in the longitudinal direction is suppressed. However, even in this case, the heat generation unevenness in the longitudinal direction is 13° C., and the fixing unevenness occurs.

Since the width of the conductive portion is increased, t/d is as large as 0.25, and the heating resistor cannot be arranged at the end of the heater substrate. For this reason, the heater cracking time margin was as short as 1.8 sec, which was disadvantageous in terms of heater cracking. The overall evaluation is NG (unacceptable) because the heat generation unevenness is 9° C. or more and the heater cracking time margin is not 2 sec or more.

In Comparative Example 2, since the width of the conductive portions 131*a* and 131*b* is set as small as 0.2 mm, t/d can be reduced to 0.19, and the heating resistor can be disposed at the end of the heater substrate. Therefore, the heater cracking time margin was increased to 4.5 sec, which was advantageous in terms of heater cracking. However, since the heat generation unevenness is 9° C. or more, the overall evaluation is NG (unacceptable).

In the present Example, as shown in Table 1, the heat generation unevenness in the longitudinal direction was 5° C., which was less than in Comparative Example 2. Also, the width of the first conductive portion 31*a* is set to be as small as 0.2 mm so that one lateral end of the first heating resistor 35*a* that is connected to the first conductive portion can be arranged close to one lateral end of the substrate. Since the width of the second conductive portion 31*b* is set to be as small as 0.2 mm so that the other lateral end of the second heating resistor 35*b* that is connected to the second conductive portion can be arranged close to the other lateral end of the substrate, t/d can be made as small as 0.19. Therefore, the heater cracking time was as long as 4.5 sec, which was advantageous in terms of heater cracking. Since the heat generation unevenness in the longitudinal direction is 9° C. or less and the heater cracking time margin is 2 seconds or more, the overall evaluation is OK (acceptable).

As described above, in the heater of the conveyance direction energizing type, it is possible to suppress the heat generation unevenness in the longitudinal direction, and at the same time, to ensure a sufficient tolerance with respect to heater cracking.

EXAMPLE 2

The configurations of the image forming apparatus and the fixing device 8 in Example 2 are the same as those in Example 1, and the description thereof is herein omitted. In the description of the present Example, components having functions similar to those of Example 1 are denoted by the same reference numerals.

In the present Example, the heater 13 of Example 1 can be commonly used in an area where a commercial power supply voltage of 100 V is supplied and an area where a commercial power supply voltage of 200 V is supplied.

When an image forming apparatus for an area where the commercial power supply voltage is of a 100 V system (for example, 100 V to 127 V) is used in an area of a 200 V system (for example, 200 V to 240 V), the maximum power that can be supplied to the heater of the fixing portion is increased by a factor of 4. When the maximum power that can be supplied to the heater increases, harmonic current, flicker, and the like generated by power control of the heater become remarkable. Therefore, when one image forming apparatus is to be made suitable for use in both an area where the commercial power supply voltage is 100 V and an area where the commercial power supply voltage is 200 V, the heater is often replaced with a heater having a different resistance value for each area.

Figure 4A:
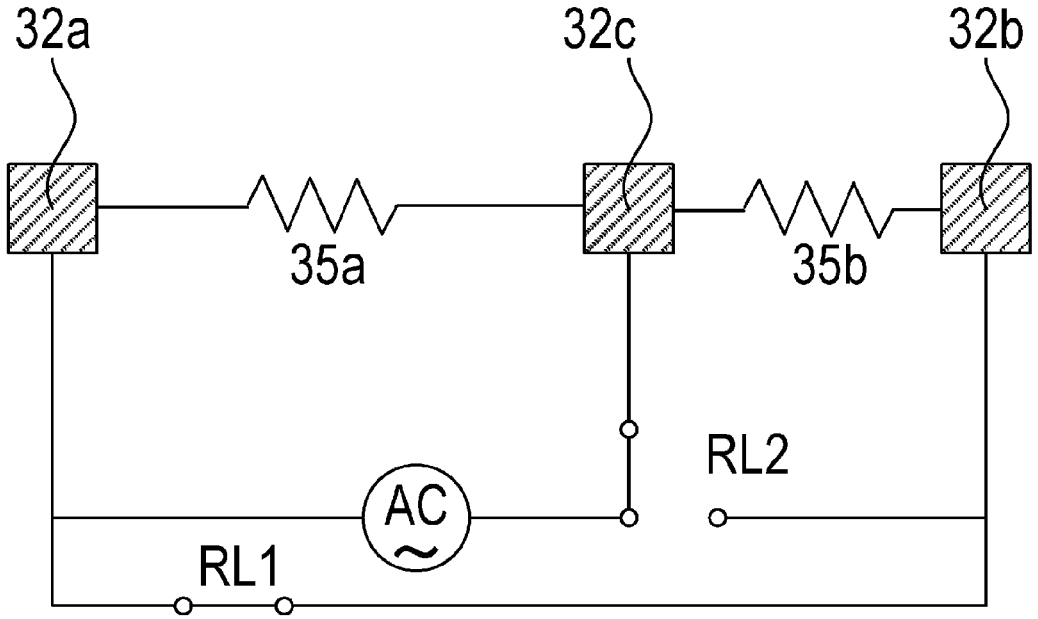
FIGS. 4A and 4B are diagrams of a circuit connected to the heater of Example 2.
Figure 4B:
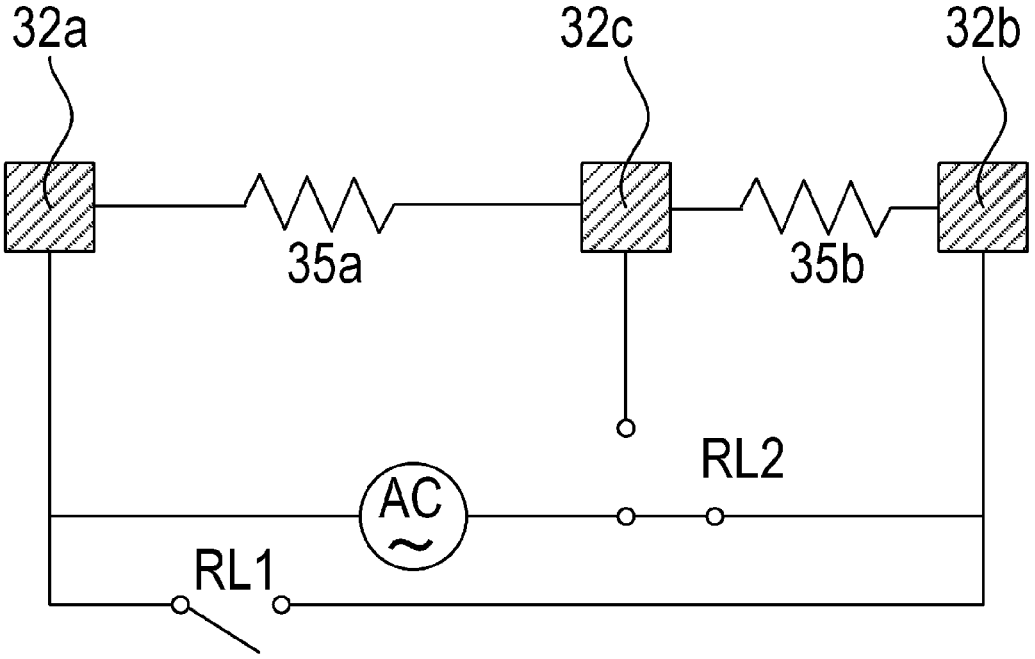

In the configuration of the present Example, the connection state of the first heating resistor 35*a* and the second heating resistor 35*b* is switched between a series connection state and a parallel connection state according to the output of the voltage detection portion that detects the power supply voltage. FIGS. 4A and 4B schematically show a circuit for the heater 13 of Example 1 shown in FIG. 2. As shown in FIGS. 4A and 4B, relays RL1 and RL2 function as connection state switching portions that switch the connection state of the first heating resistor 35*a* and the second heating resistor 35*b* between a series connection state and a parallel connection state.

When the voltage of the commercial power supply is of a 100 V system, as shown in FIG. 4A, the relay RL1 is closed to obtain a state in which the first power supply contact portion 32*a* and the second power supply contact portion 32*b* are connected to one pole of the power supply. Where the relay RL2 is closed with respect to the third power supply contact portion 32*c*, and the third power supply contact portion 32*c* is connected to the other pole of the power supply, the connection state of the first heating resistor 35*a* and the second heating resistor 35*b* is switched to a parallel connection state. As a result, the total resistance value of the heater 13 decreases. Further, when the voltage of the commercial power supply is of a 200 V system, as shown in FIG. 4B, the relay RL1 is opened and the relay RL2 is closed with respect to the second power supply contact portion 32*b*, thereby switching to a state in which the second power supply contact portion 32*b* is connected to the other pole of the power supply. At this time, the first power supply contact portion 32*a* is in a state of being connected to one pole of the power supply as in the case of the parallel connection state. The third power supply contact portion 32*c* is not connected to any pole of the power supply. With such a connection, the connection between the first heating resistor 35*a* and the second heating resistor 35*b* is changed to a series connection. As a result, the total resistance value of the heater 13 increases.

The parallel connection state of FIG. 4A of the present Example is exactly the same as the configuration of Example 1. That is, to the first heating resistor 35*a*, a voltage is applied from the first power supply contact portion 32*a* close to one end in the longitudinal direction through the first conductive portion 31*a*. To the second heating resistor 35*b*, a voltage is applied from the second power supply contact portion 32*b*, which is close to the other end in the longitudinal direction and connected to one pole of the power supply connected to the first power supply contact portion 32*a*, through the second conductive portion 31*b*. The third power supply contact portion 32*c* is close to the center in the longitudinal direction and is connected to the other pole of the powder supply that has an electrically opposite polarity to that of the one pole of the power supply to which the first power supply contact portion 32*a* and the second power supply contact portion 32*b* are connected. A voltage is applied from the third power supply contact portion 32*c* to the first heating resistor 35*a* and the second heating resistor 35*b* through the third conductive portion 31*c*. Therefore, similarly to Example 1, the heat distribution is as shown in FIG. 3A, and the heat generation unevenness in the longitudinal direction can be suppressed. Since the paste and width of the first to third conductive portions 31*a* to 31*c*, the first heating resistor 35*a*, the second heating resistor 35*b*, and the like are the same as those in Example 1, the total resistance value of the heater 13 is 20Ω which is the same as in Example 1. Meanwhile, the total resistance value of the heater 13 in the series connection state of FIG. 4B is 80Ω.

Figure 5:
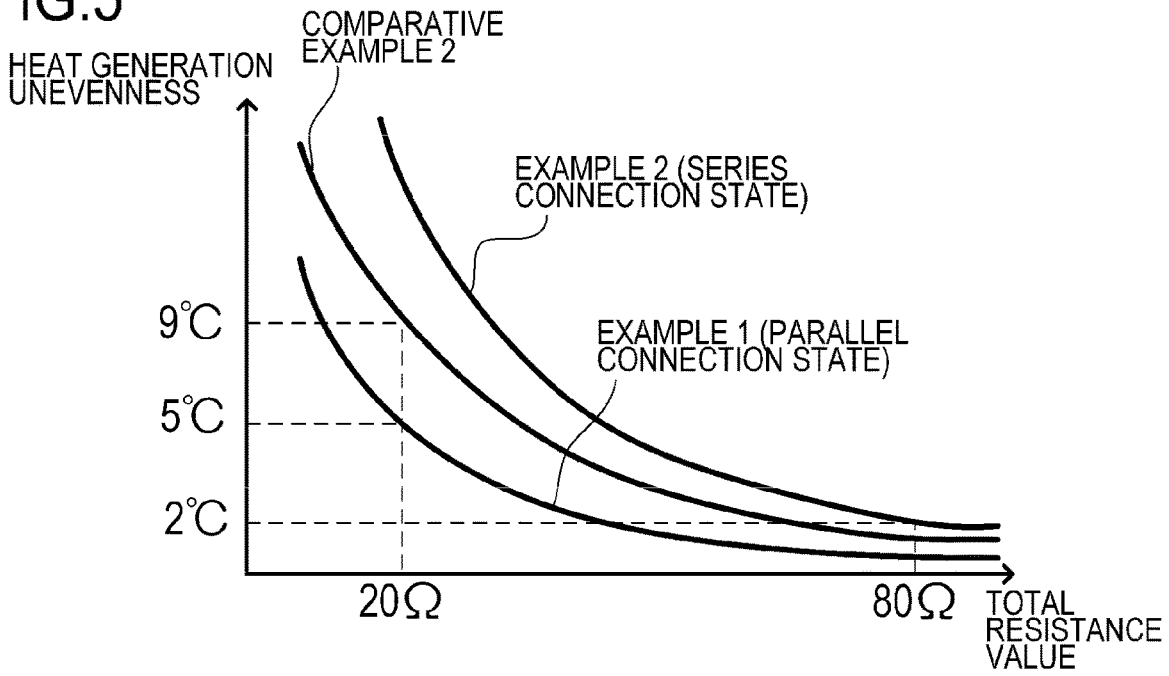
FIG. 5 is a diagram showing the relationship between the total resistance value of the heater and heat generation unevenness.

The suppression of heat generation unevenness in the longitudinal direction in the series connection state of the present Example will be described with reference to FIG. 5. FIG. 5 shows the relationship between the total resistance value of the heater 13 and the heat generation unevenness in the longitudinal direction. The heaters of Comparative Example 2, Example 1 (parallel connection state), and the present Example (series connection state) are shown. The relationship in any of the heaters is such that the heat generation unevenness in the longitudinal direction is suppressed as the total resistance increases. This is because as the resistance of the heating resistor increases, the resistance of the conductive portion relatively decreases, and thus the voltage drop on the conductive portion is less likely to occur.

Figure 6A:
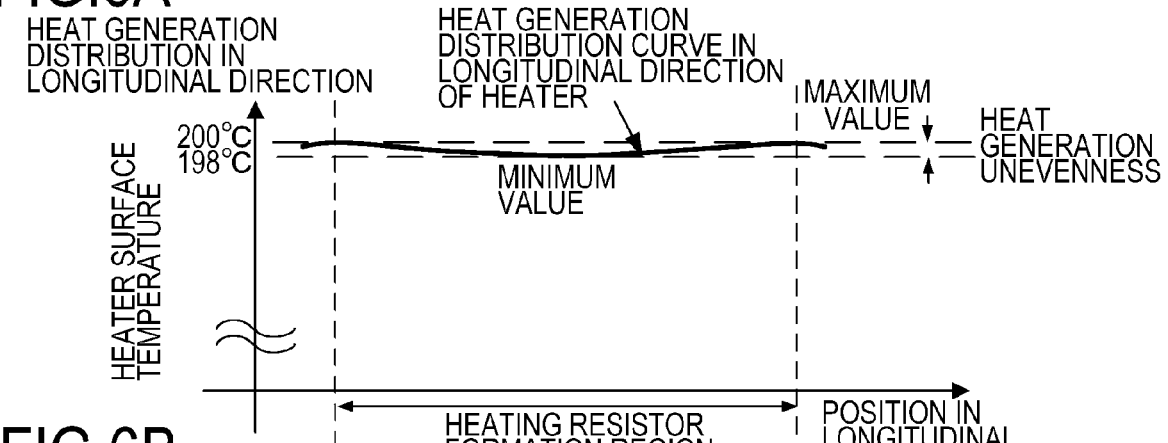
FIGS. 6A and 6B are respectively a heat generation distribution diagram and a potential distribution diagram in a series connection state of Example 2.

Next, the heat generation distribution in the longitudinal direction of the heater in the present Example (series connection state) will be described with reference to FIGS. 6A and 6B. In the series connection state of the present Example, the first power supply contact portion 32*a* is connected to one pole of the power supply, and the second power supply contact portion 32*b* is connected to the other pole of the power supply so as to have electrically opposite polarity. Since the third power supply contact portion 32*c* is not connected to any of the poles of the power supply, no voltage is applied from the third power supply contact portion 32*c* through the third conductive portion 31*c*. Therefore, a voltage drop occurs from each longitudinal end of the heater toward the opposite end. Meanwhile, no voltage is applied to the third power supply contact portion 32*c* because the relay RL2 is open. As a result, the potential difference at each longitudinal position of the first conductive portion 31*a* and the second conductive portion 31*b* becomes a potential distribution in the longitudinal direction of the first conductive portion 31*a* and the second conductive portion 31*b*. The heat generation amount at each longitudinal position of the heating resistors 35*a* and 35*b* is determined by the potential difference at each longitudinal position of the first conductive portion 31*a* and the second conductive portion 31*b*, and has a distribution such as shown by a dotted line in FIG. 6B. Therefore, as shown in FIG. 6A, the heat generation distribution has a maximum value at both ends and a minimum value at the center in the longitudinal direction of the heater. Since the total resistance value of the first heating resistor 35*a* and the second heating resistor 35*b* in the series connection state is higher than the total resistance value in the parallel connection state, the resistance values of the first conductive portion 31*a* and the second conductive portion 31*b* become relatively low. Therefore, the influence of the voltage drop on the first conductive portion 31*a* and the second conductive portion 31*b* is reduced, and the heat generation unevenness in the longitudinal direction is suppressed.

Figure 6B:
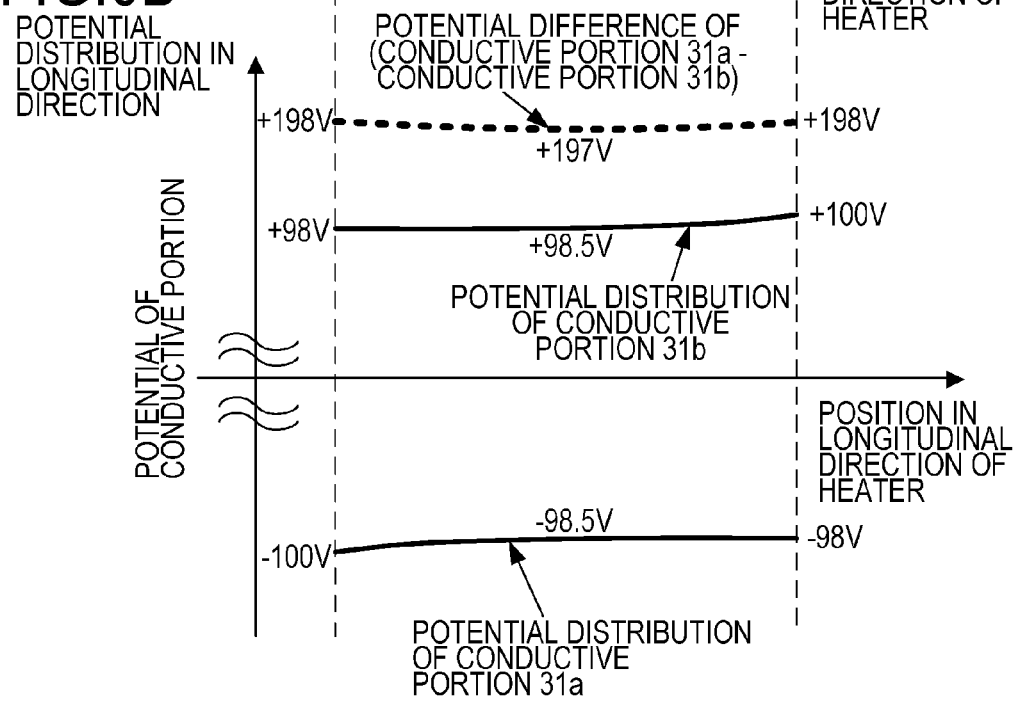

The voltage values shown in FIG. 6B are for a case where the voltage of the commercial power supply is of a 200 V system, and indicate values at a certain moment. In the present Example, since the AC voltage is applied, there is also a timing at which the second conductive portion 31*b* has a negative voltage value and the first conductive portion 31*a* has a positive voltage value.

As shown in Table 2 below, a comparison was made between the heater of Comparative Example 2, the parallel connection state of the present Example (Example 1), and the series connection state of the present Example.

TABLE 2

| | Connection state | Total resistance value | Heater pattern | t/d | Heat generation unevenness | Heater cracking time margin | Overall evaluation |
|---|---|---|---|---|---|---|---|
| Comparative Example 2 | Parallel | 20Ω | FIG. 13 | 0.19 | 9° C. (FIG. 14A) | 4.5 sec | NG |
| Example 1 | Parallel | 20Ω | FIG. 2 | 0.19 | 5° C. (FIG. 3A) | 4.5 sec | OK |
| Example 2 | Series | 80Ω | FIG. 2 | 0.19 | 2° C. (FIG. 6A) | 4.5 sec | OK |

The respective evaluation methods in Table 2 are the same as the methods described in Table 1 in Example 1, and thus description thereof is omitted.

In Comparative Example 2, as described in Table 1 of Example 1, although there is no problem with the heater cracking time margin, since the heat generation unevenness is 9° C. or more, the overall evaluation is NG (unacceptable). Further, as described in Table 1 of Example 1, the overall evaluation of the parallel connection state of the present Example is OK (acceptable) from the viewpoint of the heater cracking time and the heat generation unevenness in the longitudinal direction.

In the series connection state of the present Example, the heat generation unevenness in the longitudinal direction can be made 2° C. which is smaller than that of Comparative Example 2 or the parallel connection state (Example 1). Further, in the series connection state of the present Example, since the heater pattern is exactly the same as in the parallel connection state (Example 1), t/d is 0.19, that is, the same. For this reason, the heater cracking time was as long as 4.5 sec, which was advantageous in terms of heater cracking. Since the heat generation unevenness in the longitudinal direction is 9° C. or less and the margin for the heater cracking time is 2 sec or more, the overall evaluation is OK (acceptable).

In the present Example, the image forming apparatus is configured to be capable of detecting the power supply voltage and switching between the serial connection state and the parallel connection state, but this configuration is not limiting. For example, an image forming apparatus for an area of a 100 V system may have a circuit of a parallel connection state shown in FIG. 4A, and an image forming apparatus for an area of a 200 V system may have a circuit of a series connection state shown in FIG. 4B, that is, the circuit of the image forming apparatus may be configured to be different for an area of a 100 V system and for an area of a 200 V system.

As described above, the heater of the conveyance direction energizing type is configured such that the connection direction of the heating resistors 35*a* and 35*b* can be switched between a series connection state and a parallel connection state according to the voltage value. As a consequence, the heater can be used both in the area where the commercial power supply voltage of 100 V is supplied and in the area where the commercial power supply voltage of 200 V is supplied, while suppressing the heat generation unevenness in the longitudinal direction and at the same time, ensuring a sufficient tolerance with respect to heater cracking.

EXAMPLE 3

The configurations of the image forming apparatus and the fixing device 8 in Example 3 are the same as those in Examples 1 and 2, and the description thereof is herein omitted. In the description of the present Example, components having functions similar to those of Example 1 are denoted by the same reference numerals.

The present Example is a heater of the type that makes it possible to further improve the non-paper-passing portion temperature rise suppression effect as compared with the heaters of Examples 1 and 2. That is, the heating resistors on the heater is divided into a plurality of groups (heating blocks) in the longitudinal direction of the heater, and the heat generation distribution of the heater is switched according to the size of the recording material.

Figure 7:
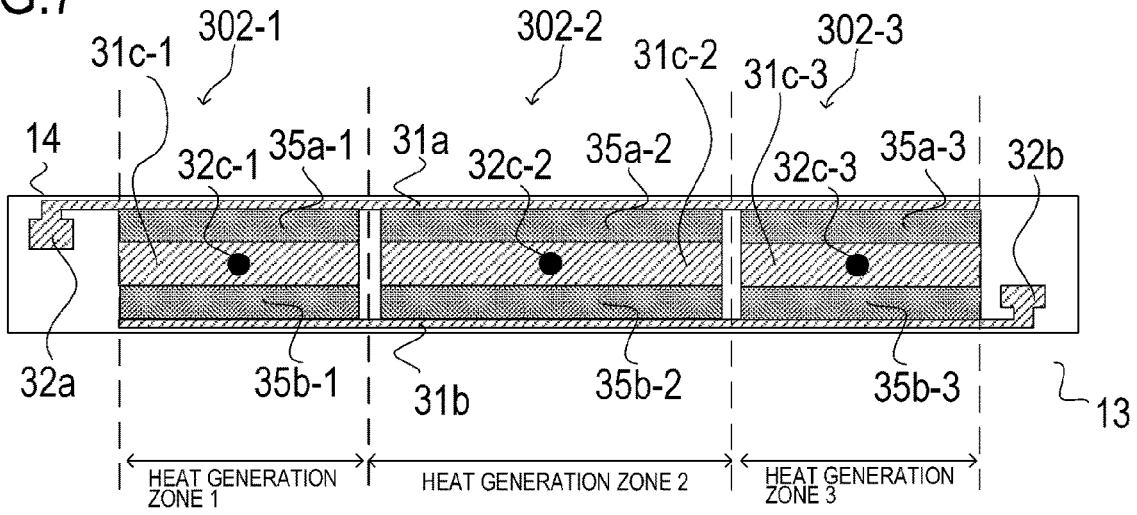
FIG. 7 is a plan view of the heater 13 to be mounted on the fixing device according to Example 3.

FIG. 7 is a plan view of the heater 13 mounted on the fixing device of the present Example. The heater 13 includes a plurality of heating blocks, each being configured to include the first heating resistor 35*a*, the second heating resistor 35*b*, the third conductive portion 31*c*, and the third power supply contact portion 32*c*, in the longitudinal direction of the heater. As an example, in the heater 13 of the present Example, a plurality of third conductive portions 31*c* is provided by division into three third conductive portions located at the center and both longitudinal ends, and a total of three heating blocks are provided at the center and both longitudinal ends. The heating block 302-1 includes heating resistors 35*a*-1, 35*b*-1, a third conductive portion 31*c*-1, and a third power supply contact portion 32*c*-1. Similarly, the heating block 302-2 includes heating resistors 35*a*-2 and 35*b*-2, a third conductive portion 31*c*-2, and a third power supply contact portion 32*c*-2. The heating block 302-3 includes heating resistors 35*a*-3 and 35*b*-3, a third conductive portion 31*c*-3, and a third power supply contact portion 32*c*-3. These heating blocks 302-1 to 302-3 are connected in parallel to the first conductive portion 31*a* and the second conductive portion 31*b*. Further, the first power supply contact portion 32*a* close to one longitudinal end is connected so as to apply a voltage (supply electric power) to the heating resistor through the first conductive portion 31*a*. A second power supply contact portion 32*b* close to the other longitudinal end is connected so as to apply a voltage (supply power) to the heating resistor through the second conductive portion 31*b*. The third conductive portions 31*c*-1 to 31*c*-3 included in the heating blocks 302-1 to 302-3 are connected to the power supply contact portions 32*c*-1 to 32*c*-3, respectively, to apply a voltage. Thus, each heating block has a heating resistor and a conductive portion that are separate from the other heating blocks. A heat generation zone 1 which is a heating region of the heating block 302-1, a heat generation zone 2 which is a heating region of the heating block 302-2, and a heat generation zone 3 which is a heating region of the heating block 302-3 are independently controlled. When the size of the recording material fits within the heat generation zone 2, the non-paper-passing portion temperature rise can be reduced by supplying power supply only to the heat generation block 302-2.

Figure 8:
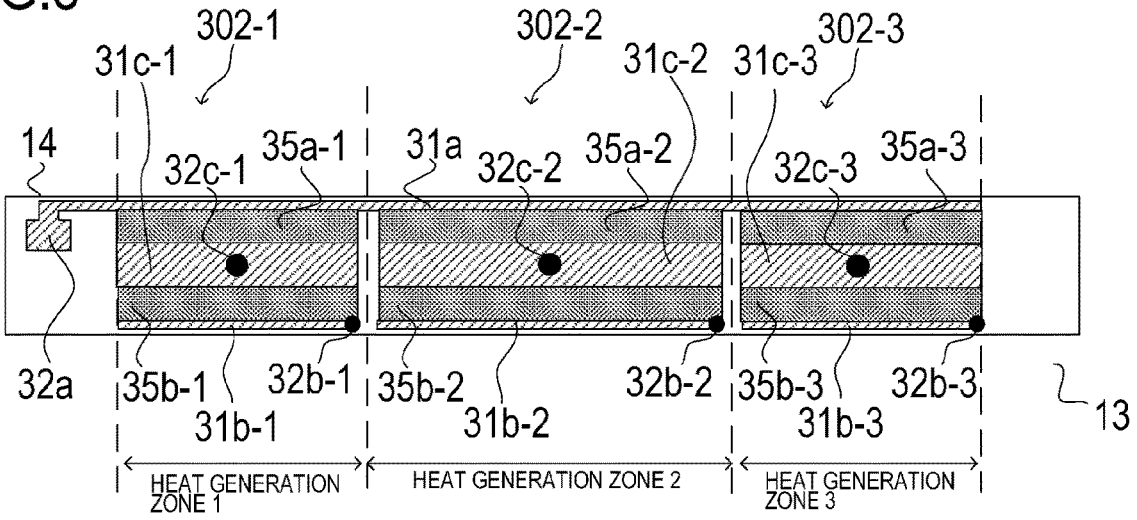
FIG. 8 is a plan view of the heater 13 to be mounted on the fixing device according to Example 3.
Figure 9:
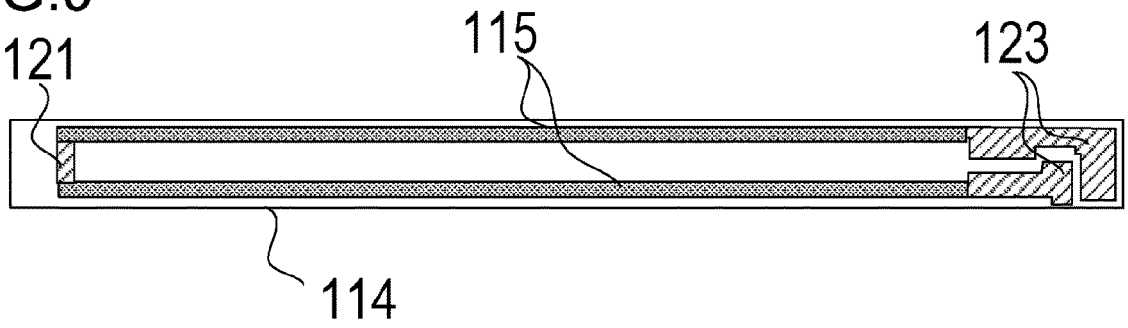
FIG. 9 is a plan view of a heater of a longitudinal direction energizing type.

In the present Example, the division is performed into three heating blocks that can be independently controlled, but more heating blocks may be provided. As shown in FIG. 8, it is possible to combine a type having a plurality of heating blocks as in the present Example and a type capable of switching between a parallel connection state and a series connection state as in the Example 2. For example, when the voltage of a commercial power supply is of a 100 V system and heat is generated in the heat generation zone 2, by applying a voltage of the same polarity to the conductive portion 31*a* and the conductive portion 31*b*-2 and a voltage of the opposite polarity to the conductive portion 31*c*-2, heat is generated in the parallel connection state of the heating resistors 35*a*-2 and 35*b*-2. When the voltage of a commercial power supply is of a 200 V system and heat is generated in the heat generation zone 2, by applying a voltage of opposite polarities to the conductive portion 31*a* and the conductive portion 31*b*-2, heat is generated in the series connection state of the heating resistors 35*a*-2 and 35*b*-2.

As described above, according to the configuration of the present Example, in the heater of the conveyance direction energizing type, it is possible to suppress heat generation unevenness in the longitudinal direction, and at the same time, to ensure a sufficient tolerance against heater cracking. Further, by switching the heat generation distribution of the heater in accordance with the size of the recording material, the non-paper-passing portion temperature rise can be further reduced. Further, the heater can be used in both an area where a 100 V commercial power supply voltage is supplied and an area where a 200 V commercial power supply voltage is supplied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-098536, filed on May 27, 2019, which is hereby incorporated by reference herein in its entirety.

What is claimed is:

1. A heater to be used in an image heating device that heats an image formed on a recording material, the heater comprising:

a substrate;

a first heating resistor that is provided on the substrate along a longitudinal direction of the substrate and generates heat with electric power supplied from a power supply, the first heating resistor including one lateral end and another lateral end in a lateral direction perpendicular to the longitudinal direction;

a second heating resistor that is provided on the substrate along the longitudinal direction of the substrate in parallel with the first heating resistor and generates heat with electric power supplied from the power supply, the second heating resistor including one lateral end and another lateral end in the direction perpendicular to the longitudinal direction;

a first electric contact portion for electric connection to the power supply;

a first conductive portion that electrically connects the first electric contact portion with the one lateral end of the first heating resistor on the side opposite that facing the second heating resistor, the first conductive portion being electrically connected to the first heating resistor on the one lateral end of the first heating resistor throughout the longitudinal direction;

a second electric contact portion for electric connection to the power supply;

a second conductive portion that electrically connects the second electric contact portion with the other lateral end of the second heating resistor on the side opposite that facing the first heating resistor, the second conductive portion being electrically connected to the second heating resistor on the other lateral end of the second heating resistor throughout the longitudinal direction;

a third electric contact portion for electric connection to the power supply; and a third conductive portion that electrically connects the third electric contact portion with the other lateral end of the first heating resistor and also electrically connects the third contact portion with the one lateral end of the second heating resistor, the third conductive portion being electrically connected to the first heating resistor on the other lateral end of the first heating resistor throughout the longitudinal direction and being electrically connected to the second heating resistor on the one lateral end of the second heating resistor throughout the longitudinal direction, wherein, in the heater, the first electric contact portion is provided close to one longitudinal end of the substrate, the second electric contact portion is provided close to the other longitudinal end of the substrate, and the third electric contact portion is provided close to the center of the substrate in the longitudinal direction, and wherein the heater is configured such that the first electric contact portion and the second electric contact portion are electrically connected to one pole of the power supply, and the third electric contact portion is electrically connected to the other pole of the power supply, respectively.

2. The heater according to claim 1, wherein in the lateral direction of the heater, the one lateral end of the first heating resistor that is connected to the first conductive portion is disposed close to one lateral end of the substrate; and the other lateral end of the second heating resistor that is connected to the second conductive portion is disposed close to another lateral end of the substrate.

3. The heater according to claim 1, wherein a portion of the first conductive portion that is connected to the one lateral end of the first heating resistor throughout the longitudinal direction, and a portion of the second conductive portion that is connected to the other lateral end of the second heating resistor throughout the longitudinal direction are each formed to extend in the longitudinal direction of the substrate;

wherein the third conductive portion is formed to extend in the longitudinal direction while being sandwiched between the first heating resistor and the second heating resistor; and wherein a width of the third conductive portion in the lateral direction is larger than the width of the first conductive portion and the second conductive portion in the lateral direction.

4. The heater according to claim 1, wherein a plurality of heating blocks each being configured to include the first heating resistor, the second heating resistor, the third conductive portion, and the third electric contact portion is arranged in the longitudinal direction of the substrate, and the plurality of the heating blocks are connected to the first conductive portion and the second conductive portion in parallel with each other.

5. An image heating device that heats an image formed on a recording material by using heat of a heater, the image heating device comprising:

a heating unit including the heater according to claim 1; and a switching portion for switching between a state where the first electric contact portion and the second electric contact portion are electrically connected to one pole of the power supply, and the third electric contact portion is electrically connected to the other pole of the power supply, and a state where the first electric contact portion is electrically connected to one pole of the power supply, the second electric contact portion is electrically connected to the other pole of the power supply, and the third electric contact portion is not electrically connected to either pole of the power supply.

6. The image heating device according to claim 5, wherein the switching portion switches to the state where the first electric contact portion and the second electric contact portion are electrically connected to one pole of the power supply, and the third electric contact portion is electrically connected to the other pole of the power supply when a commercial power supply voltage applied to the first heating resistor and the second heating resistor is of a 100 V system, and wherein the switching portion switches to the state where the first electric contact portion is electrically connected to one pole of the power supply, the second electric contact portion is electrically connected to the other pole of the power supply, and the third electric contact portion is not electrically connected to either pole of the power supply when a commercial power supply voltage applied to the first heating resistor and the second heating resistor is of a 200 V system.

7. The image heating device according to claim 5, further comprising:

a cylindrical film; and a roller configured to be in contact with an outer surface of the film, wherein the heating unit is provided in an inner space of the film, and wherein a nip portion for pinching and conveying the recording material is formed by the heater and the roller through the film.

8. An image forming apparatus comprising:

an image forming portion that forms a toner image on a recording material; and a fixing portion that fixes the toner image formed by the image forming portion to the recording material, wherein the fixing portion is the image heating device according to claim 5.

9. An image heating device that heats an image formed on a recording material by using heat of a heater, the image heating device comprising:

a heating unit including the heater according to claim 1.

10. The image heating device according to claim 9, further comprising:

a cylindrical film; and a roller configured to be contact with an outer surface of the film, wherein the heating unit is provide in an inner space of the film, and wherein a nip portion for pinching and conveying the recording material is formed by the heater and the roller through the film.

11. An image forming apparatus comprising:

an image forming portion that forms a toner image on a recording material; and a fixing portion that fixes the toner image formed by the image forming portion to the recording material, wherein the fixing portion is the image heating device according to claim 9.

* * * * *